US012467209B2

(12) United States Patent
Gao et al.

(10) Patent No.: US 12,467,209 B2
(45) Date of Patent: Nov. 11, 2025

(54) REAL-TIME DETECTING SYSTEM FOR THE MECHANICAL QUALITY STATE OF BALLAST BED BASED ON TAMPING CAR

(71) Applicant: Beijing Jiaotong University, Beijing (CN)

(72) Inventors: Liang Gao, Beijing (CN); Shunwei Shi, Beijing (CN); Hui Yin, Beijing (CN); Xiaopei Cai, Beijing (CN); Meng Xu, Beijing (CN); Hong Xiao, Beijing (CN); Bowen Hou, Beijing (CN); Yanglong Zhong, Beijing (CN); Yixiong Xiao, Beijing (CN); Ji Wang, Beijing (CN)

(73) Assignee: Beijing Jiaotong University, Beijing (CN)

( * ) Notice: Subject to any disclaimer, the term of this patent is extended or adjusted under 35 U.S.C. 154(b) by 515 days.

(21) Appl. No.: 18/073,052

(22) Filed: Dec. 1, 2022

(65) Prior Publication Data

US 2023/0193566 A1 Jun. 22, 2023

(30) Foreign Application Priority Data

Dec. 16, 2021 (CN) ..... 2021115440521

(51) Int. Cl.
*E01B 27/16* (2006.01)
*E01B 35/00* (2006.01)

(52) U.S. Cl.
CPC ..... *E01B 27/16* (2013.01); *E01B 35/00* (2013.01); *E01B 2203/12* (2013.01)

(58) Field of Classification Search
CPC ..... E01B 27/16; E01B 35/00; E01B 2203/12
See application file for complete search history.

(56) References Cited

U.S. PATENT DOCUMENTS

2016/0010287 A1* 1/2016 Lichtberger ..... E01B 27/16 104/10

FOREIGN PATENT DOCUMENTS

| | | |
|---|---|---|
| CN | 113255066 A | 8/2021 |
| CN | 214215780 U | 9/2021 |
| CN | 214277014 U | 9/2021 |

* cited by examiner

*Primary Examiner* — Robert J McCarry, Jr.
(74) *Attorney, Agent, or Firm* — Nitin Kaushik

(57) ABSTRACT

The system includes a track lining apparatus and two tamping apparatuses arranged in parallel, wherein the track lining apparatus includes two track lining hydro-cylinders, and the track lining hydro-cylinder communicates with a hydraulic control system through an oil inlet pipeline and an oil return pipeline; pressure sensors configured to detect pressures of the pipelines are provided on the oil inlet pipeline and the oil return pipeline; the tamping apparatus includes two pairs of tamping components arranged on both sides, where the tamping component includes a pair of packer arms and two pairs of packers; a dynamic force sensor is provided at a joint between the packer arm and the packer, and the dynamic force sensor can detect a transient dynamic downward insertion force generated when the packer is inserted into the ballast bed.

6 Claims, 12 Drawing Sheets

REAL-TIME DETECTING SYSTEM FOR THE MECHANICAL QUALITY STATE OF BALLAST BED BASED ON TAMPING CAR

CROSS-REFERENCE TO RELATED APPLICATIONS

The application claims priority to Chinese patent application No, 2021115440521, filed on Dec. 16, 2021, the entire contents of which are incorporated herein by reference.

TECHNICAL FIELD

The present application relates to the technical field of ballast bed quality detection, and in particular to a tamping car-based system for detecting a mechanical quality state of a ballast bed in real time.

BACKGROUND

In China, the practice of maintenance of ballast lines has developed from manual operation and small-sized road maintenance machinery to large-sized road maintenance machinery by leaving a blank in the train timetable for line maintenance. The main operation modes of the large-sized road maintenance machinery are tamping and stabilization, where the tamping operation can increase the compactness of the ballast bed under the sleeper and improve the elasticity of the ballast bed; the stabilization operation can make the ballast bed quickly reach a stable state to shorten the speed limiting time of the train. However, under the impact and disturbance of the tamping, the ballast is very easy to break, and the ballast gradation is changed, as a result, the strength and stability of the ballast bed are reduced. At present, the large-sized machinery operation in China is mostly arranged according to experiences and adopts the same operation mode, without considering the different mechanical quality states of different lines or that even different sections of the ballast bed of the same line are different. Therefore, the maintenance effect of the large-sized machinery operation is poor, the quality guarantee period of the line is short, and a better effect of the large-sized machinery tamping operation is desirable.

In view of the above defects, it is necessary to perform the targeted large-sized machinery tamping operation according to different mechanical quality states of the ballast bed, so as to lay a foundation for achieving the intelligent maintenance operation of the large-sized machinery, How to acquire the state of the ballast bed in time during the large-sized machinery operation is a key problem which needs to be solved urgently at present.

SUMMARY

Embodiments of the present application provide a tamping car-based system for detecting a mechanical quality state of a ballast bed in real time, which can detect the mechanical quality state of the ballast bed in real time during track lining and tamping, save a lot of manpower and material resources, improve detection accuracy, and guide a follow-up large-sized machinery operation mode in real time according to the detection result.

In order to achieve the above object, the embodiments of the present application provide a tamping car-based system for detecting a mechanical quality state of a ballast bed in real time, including a track lining apparatus and two tamping apparatus arranged in parallel, wherein the track lining apparatus includes two track lining hydro-cylinders, the track lining hydro-cylinders communicate with a hydraulic control system through an oil inlet pipeline and an oil return pipeline, and pressure sensors configured to detect pressures of the pipelines are arranged on both the oil inlet pipeline and the oil return pipeline; the tamping apparatus includes two pairs of tamping components arranged on both sides, the tamping component includes a pair of packer arms and two pairs of packers, a dynamic force sensor is provided at a joint between the packer arm and the packer, and the dynamic force sensor can detect a transient dynamic downward insertion force generated when the packer is inserted into the ballast bed.

Furthermore, the tamping car-based system for detecting a mechanical quality state of a ballast bed in real time further includes a data processing unit, wherein the data processing unit is electrically connected with the pressure sensors and can receive pipeline pressures detected by the pressure sensors and output a thrust of a piston rod.

Furthermore, the pressure sensor is a diffused silicon pressure transmitter, and the diffused silicon pressure transmitter is connected to the oil inlet pipeline or the oil return pipeline through an impulse pipe.

Furthermore, the packer arms and the packers are connected through bolts, the dynamic force sensors are quartz dynamic impact force sensors, and the quartz dynamic impact force sensors are sleeved on an outside of the bolts.

Furthermore, reinforced grommets are arranged between the quartz dynamic impact force sensors and the packer arms and between the quartz dynamic impact force sensors and the packers.

Furthermore, the hydraulic control system further includes a one-way hydraulic pump, a three-position four-way directional control valve is arranged between the track lining hydro-cylinders and the one-way hydraulic pump, and the pressure sensors are positioned on pipelines between the track lining hydro-cylinders and the three-position four-way directional control valve.

Furthermore, the three-position four-way directional control valve is a P-type three-position four-way servo solenoid directional control valve.

Furthermore, the hydraulic control system further includes an oil tank, a relief valve is further arranged on a pipeline between the one-way hydraulic pump and the three-position four-way directional control valve, and an outlet of the relief valve communicates with the oil tank.

Furthermore, the two track lining hydro-cylinders are arranged in cross parallel.

Compared with the prior art, the present application has the following beneficial effects.

1. In the present application, by reforming the existing tamping car, adding the dynamic impact force sensors to the tamping apparatuses to obtain a transient dynamic downward insertion force generated when the packer is inserted downward into the ballast bed, and adding the pressure transmitter in the track lining apparatus to indirectly obtain a track lining power, the system can then detect the mechanical quality state of the ballast bed in real time during track lining and tamping, which may save a lot of manpower and material resources, improve detection accuracy, and guide the mode of a follow-up large-sized machinery operation in real time according to the detection result.

BRIEF DESCRIPTION OF DRAWINGS

To more clearly explain the technical solutions in the embodiments of the present application or the prior art, the following will briefly introduce the drawings needed in the description of the embodiments or the prior art. Obviously, the drawings in the following description are merely some embodiments of the present application. For those of ordinary skilled in the art, other drawings can be acquired according to these drawings without paying creative effort.

DETAILED DESCRIPTION OF THE EMBODIMENTS

Figure 1:
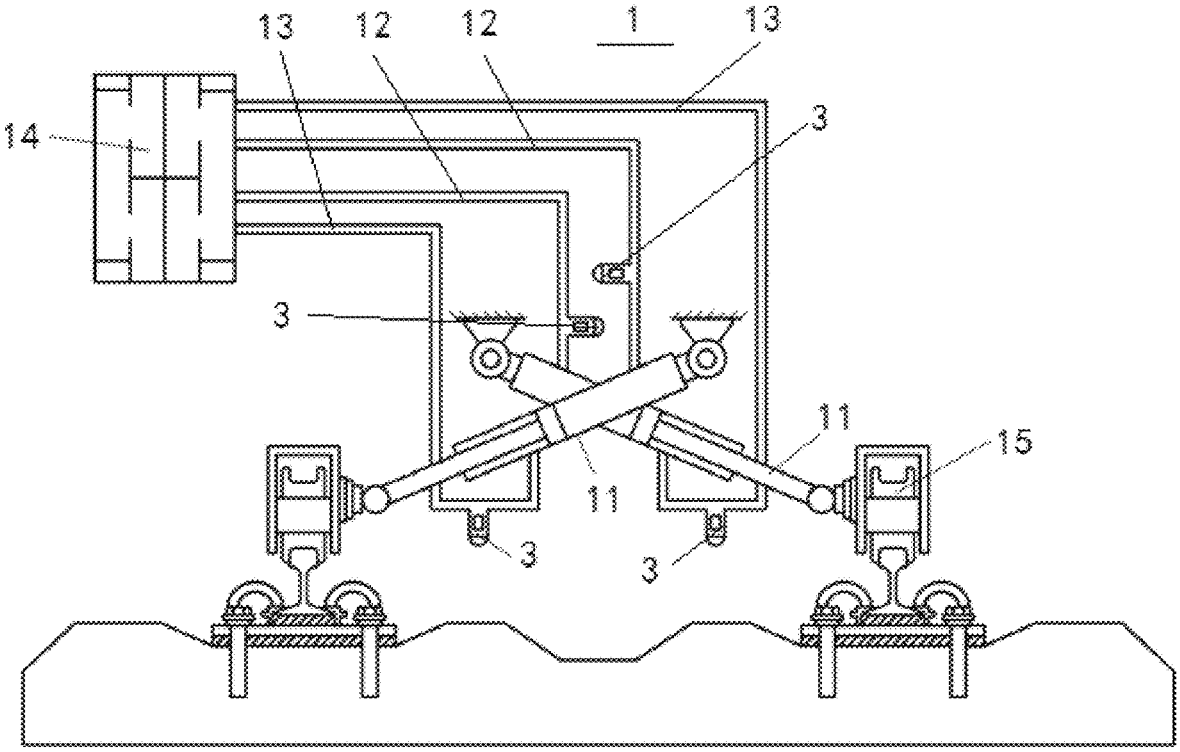
FIG. 1 is a front view of a track lining apparatus in a tamping car-based system for detecting a mechanical quality state of a ballast bed in real time according to an embodiment of the present application.

The technical solutions in embodiments of the present application will be described clearly and completely with reference to the drawings in the embodiments of the present application, and it is obvious that the described embodiments are merely, some embodiments of the present application, and not all embodiments. All other embodiments acquired by those of ordinary skilled in the art based on the embodiments in the present application without making any creative labor fall within the protection scope of the present application.

In the description of the present application, it should be understood that the terms "center", "upper", "lower", "front", "rear", "left", "right", "vertical", "horizontal", "top", "bottom", "inner", "outer", and the like indicate orientations or positional relationships based on those shown in the drawings, which is merely for the convenience of describing the present application and simplifying the description, rather than indicating or implying that the apparatus or element referred to must have a specific orientation, be constructed and operate in the specific orientation, so it cannot be understood as a limitation to the present application.

In the description of the present application, it should be noted that, unless otherwise explicitly stated or limited, the terms "mounted", "connected", and "connection" should be understood in a broad sense, and may be, for example, a fixed connection, a detachable connection, or an integral connection, and the specific meaning of the above terms in the present application can be understood according to the specific situation for those of ordinary skilled in the art.

The terms "first" and "second" are merely for the purpose of description and are not to be understood as indicating or implying relative importance or implying the number of indicated technical features. Thus, a feature as "first" or "second" may explicitly or implicitly include one or more of that feature. In the description of the present application, the meaning of "a plurality" is two or more unless otherwise specified.

A purpose of a large-sized machinery operation is to improve a mechanical quality state of a ballast bed, so that a judgment of an operation effect is very crucial to acquisition of the mechanical quality state of the ballast bed in a large-sized machinery operation process. At present, the detection of the mechanical quality state of the ballast bed is mostly based on the ballast bed, and additional devices are used manually to directly measure. The detection of the mechanical quality state of the ballast bed includes the detection of anti-transverse interference capability to the ballast bed, compactness of the ballast bed, vertical supporting capability of the ballast bed and the like.

A ballast bed transverse mechanical property is generally expressed by an anti-transverse deformation capability of the ballast bed, which is commonly detected by a single sleeper measuring method and a track frame measuring method.

The single sleeper measuring method is a well-developed method of measuring the anti-transverse deformation capability of the ballast bed at present, and is less limited by field experiments and operation conditions than other methods. With a prerequisite that the ballast bed is not destroyed, all fasteners and backing plates of a test sleeper are demolished, a loading apparatus is mounted at one end of the test sleeper, a displacement test apparatus is mounted at the other end, and a transverse displacement and load of the test sleeper are collected while slowly loading. When the displacement is 2 mm, the corresponding transverse load can reflect a transverse mechanical property of the ballast bed at this time.

Compared with the single sleeper measuring method, in the track frame measuring method, it is not necessary to demolish the fasteners and backing plates between the sleeper and steel rail, hence a measuring efficiency is improved. A transverse force is slowly applied to the steel rail and collected by directly using the loading apparatus; meanwhile, the transverse displacement of the steel rail is synchronously recorded by the displacement test apparatus. When the displacement of the steel rail is 2 mm, the corresponding transverse load can reflect the anti-transverse deformation capability of the track frame.

The vertical mechanical property of the ballast bed is generally expressed as a anti-vertical deformation capability of the ballast bed and is closely related to the compactness of the ballast bed, and the detection method includes the detection of the compactness of the ballast bed and the detection of the anti-vertical deformation capability.

The detection of the compactness of the ballast bed is generally in-situ measurement on site by means of an irrigation method, a nuclear densimeter, and a gamma-ray ballast bed densimeter. The irrigation method includes steps of placing a densimeter on a flat ballast surface, injecting water into a water tank to obtain an initial water level, removing the densimeter, sampling the ballast, placing a water bag in a pit left after sampling, injecting the water in the water tank into the water bag, measuring a residual water level of the water tank after the water bag is filled with water, weighing a ballast sample taken out, sinking it into the water tank, and measuring a final water level. A porosity of the ballast bed is calculated according to the water level so as to obtain the compactness of the ballast bed. The nuclear densitometer and gamma-ray densitometer are both employed in isotope methods, and the currently common densitometer is an SM-1 type ballast bed densitometer. When the ray passes through the ballast bed, it is absorbed by the ballast bed and subjected to attenuation of intensity. Given the thickness of the ballast bed and an absorption coefficient of the ray, a designated instrument with a certain radiative resource and constant intensity before passing through the ballast bed can be calibrated indoors, a calibration curve is made, then an intensity value of the ray after passing through a ballast bed medium is measured according to the given transmission thickness at the site, and the compactness of the ballast bed is directly checked on the calibration curve.

The detection of the anti-vertical deformation capability of the ballast bed includes steps of demolishing the fastener of the test sleeper, drawing out the backing plate, symmetrically mounting the loading apparatus and displacement meter on two sides of the steel rail along an axis of the test sleeper, slowly loading by using the steel rail as a reaction force fulcrum, synchronously collecting the vertical displacement and load of the sleeper, and respectively collecting corresponding displacement readings after loading to 7.5 kN and 35 kN, so that a relationship curve of the vertical displacement and applied load of the ballast bed can be drawn, and a slope of the curve can reflect the anti-vertical deformation capability of the ballast bed.

The prior art is defective because: 1. it has hysteresis, failing to reflect the mechanical quality state of the ballast bed in time, neither representative nor accurate enough to guide a large-sized machinery tamping operation; 2. the work is complex, a large amount of manpower and material resources are consumed, and the efficiency is low; and 3. the personal safety of the measurer cannot be guaranteed in the measurement, and the track structure is damaged to an extent.

To solve the above technical problems, the embodiments of the present application provide a tamping car-based system for detecting a mechanical quality state of a ballast bed in real time, the existing apparatus is comprehensively upgraded with additional devices, and main additional devices may include track lining apparatus additional devices and tamping apparatus additional devices. The track lining system additional devices include four pressure transmitters and an impulse pipe corresponding to each pressure transmitter, which are respectively mounted on two track lining hydro-cylinders, wherein the oil inlet pipe and oil return pipe for each track lining hydro-cylinder is respectively provided with one pressure transmitter (two pairs, four in total). The tamping apparatus additional devices include thirty-two dynamic impact force sensors, which are respectively mounted on packers of each set of tamping apparatus, wherein each set of tamping apparatus includes sixteen packers in total, and each packer is respectively provided with one dynamic impact force sensor (two sets, thirty-two in total).

Figure 2:
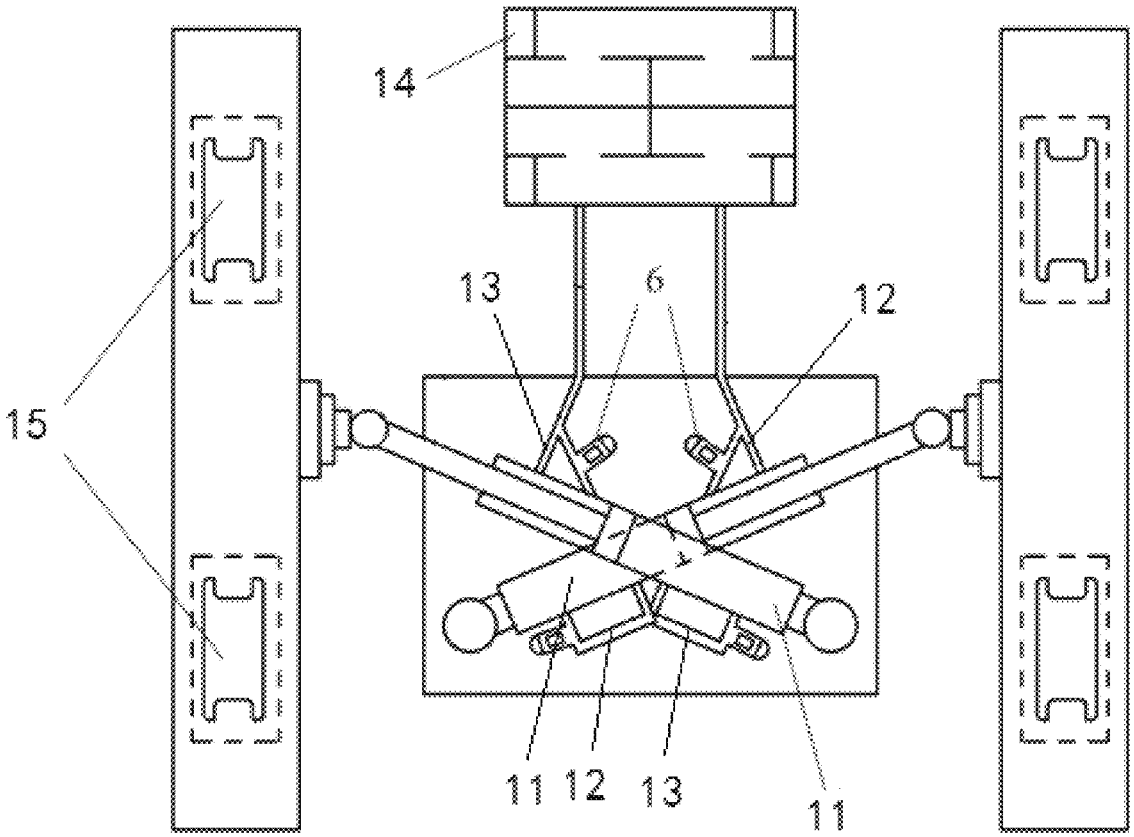
FIG. 2 is a top view of a track lining apparatus in a tamping car-based system for detecting a mechanical quality state of a ballast bed in real time according to an embodiment of the present application.
Figure 3:
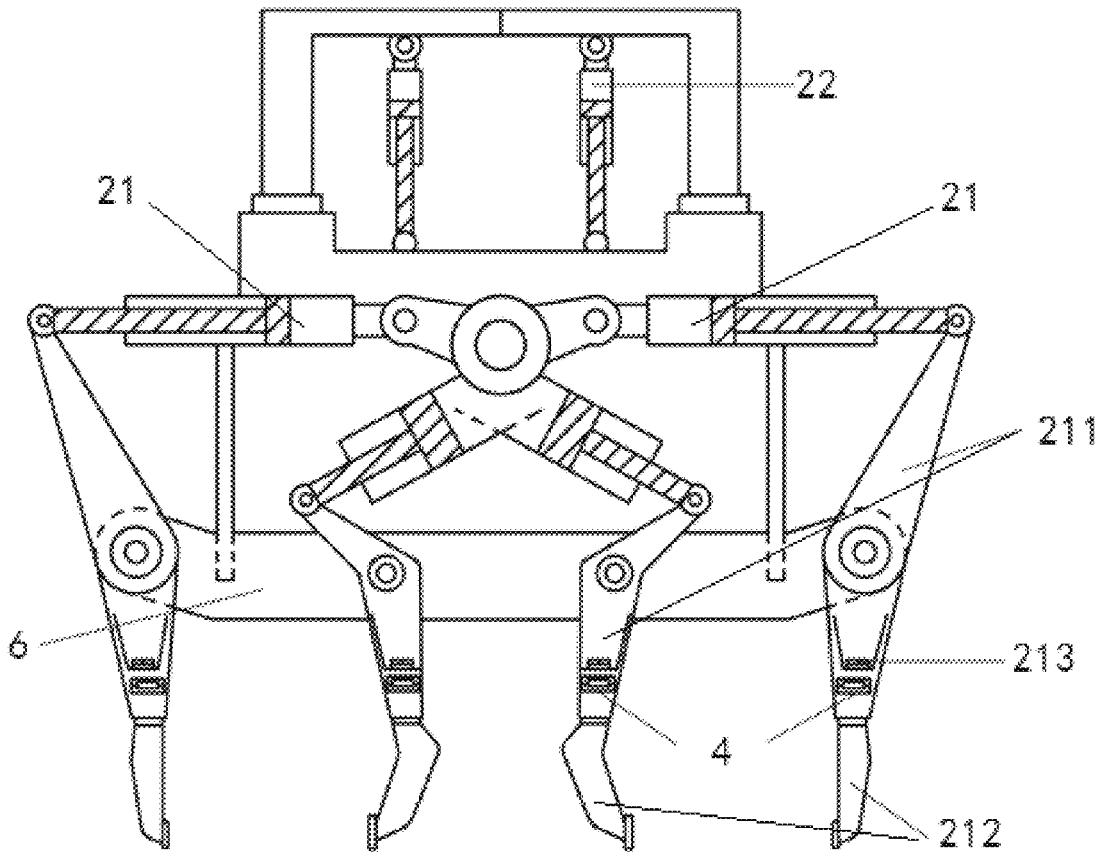
FIG. 3 is a front view of a tamping apparatus in a tamping car-based system for detecting a mechanical quality state of a ballast bed in real time according to an embodiment of the present application.
Figure 4:
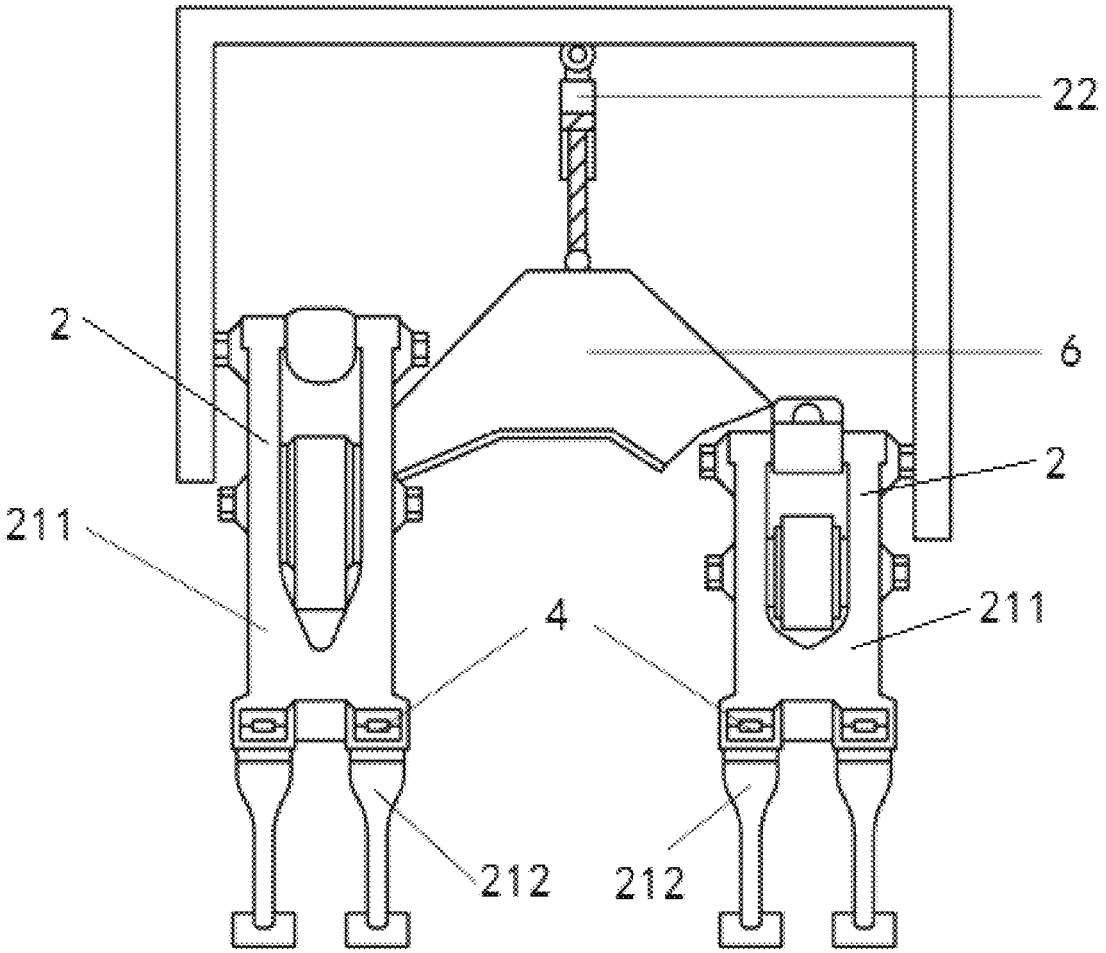
FIG. 4 is a side view of a tamping apparatus in a tamping car-based system for detecting a mechanical quality state of a ballast bed in real time according to an embodiment of the present application.

Referring to FIGS. 1 to 4, a tamping car-based system for detecting a mechanical quality state of a ballast bed in real time according to the embodiments of the present application includes a track lining apparatus 1, two tamping apparatuses 2 arranged in parallel, and a data processing unit (not shown in the figures). Referring to FIGS. 1 and 2, the track lining apparatus 1 includes two track lining hydro-cylinders 11 arranged crosswise and the track lining hydro-cylinders 11 communicate with a hydraulic control system 14 through an oil inlet pipeline 12 and an oil return pipeline 13. Pressure sensors configured to detect pipeline pressures are arranged on both the oil inlet pipeline 12 and the oil return pipeline 13. Specifically, the pressure sensor is a diffused silicon pressure transmitter 3, and the diffused silicon pressure transmitter 3 is connected to the oil inlet pipeline 12 or the oil return pipeline 13 through an impulse pipe.

The data processing unit is electrically connected with the pressure sensors and can receive pressures of the oil inlet pipeline 12 and the oil return pipeline 13 detected by the pressure sensors and output a thrust of a piston rod, that is, an action force applied to the ballast bed by a track lining wheel, so that the transverse mechanical property of the ballast bed is reflected.

The working mechanism of the hydraulic diffused silicon pressure transmitter 3 is as follows.

Figure 5:
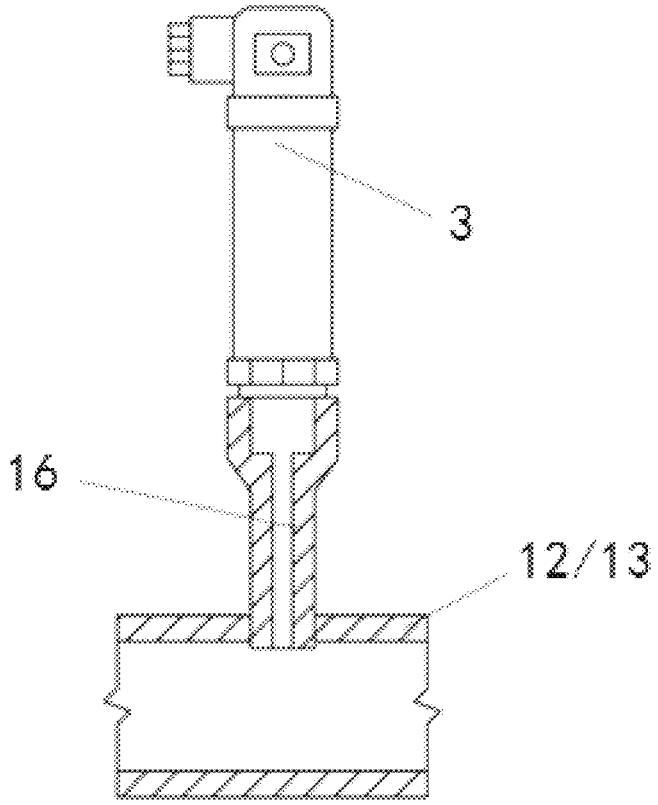
FIG. 5 is a schematic structural diagram of installation of a pressure sensor in a tamping car-based system for detecting a mechanical quality state of a ballast bed in real time according to an embodiment of the present application.
Figure 6:
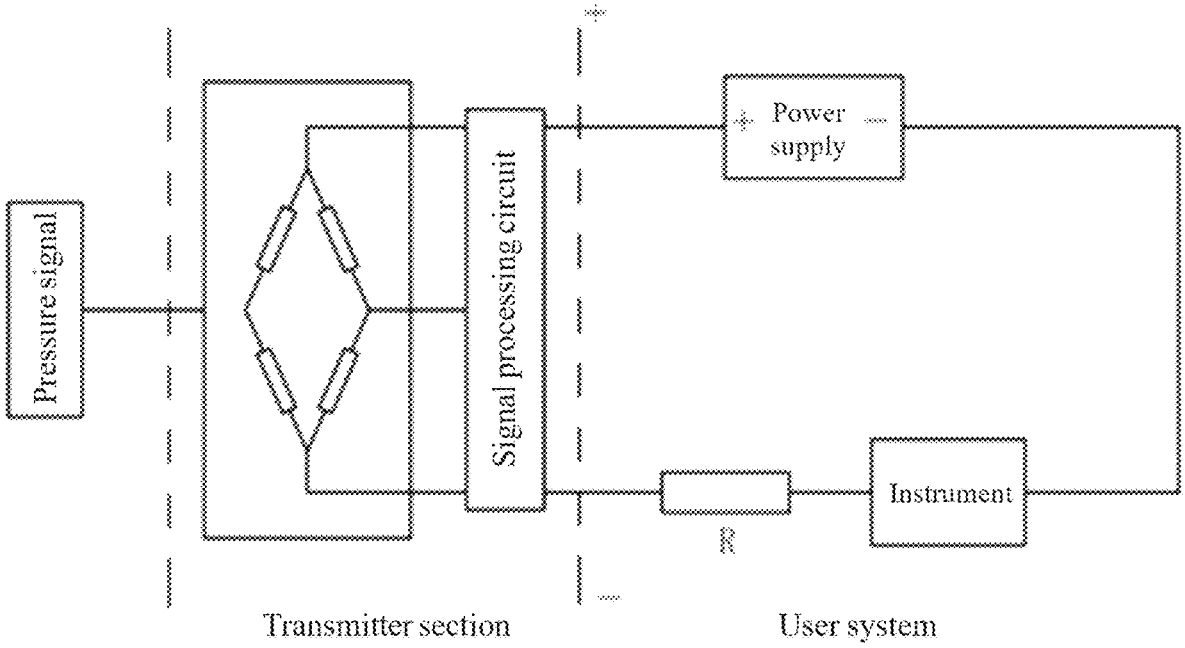
FIG. 6 is a diagram of an operating principle of a pressure sensor in a tamping car-based system for detecting a mechanical quality state of a ballast bed in real time according to an embodiment of the present application.

Referring to FIGS. 5 and 6, an impulse pipe 16 is arranged on the oil inlet pipeline 12 or the oil return pipeline 13 and connected with the diffused silicon pressure transmitter 3; at this time, an oil pressure in the oil inlet pipeline 12 or the oil return pipeline 13 can be sensed by the diffused silicon pressure transmitter 3; a piezoresistive effect of a single crystal silicon is utilized, the single crystal silicon is used as a conductor, an elastic element is formed by a micro-machining technology according to a specific crystal orientation, four equivalent strain resistances are formed by an integrated circuit process at appropriate positions in the elastic element to form a Wheatstone bridge; a constant voltage (current) is applied to the bridge, when a pressure (differential pressure) is applied to the elastic element, a resistance value of each bridge arm of the bridge changes; and the resistance value is converted into a voltage change through a signal processing circuit and finally converted into a standard signal to be output.

Figure 7:
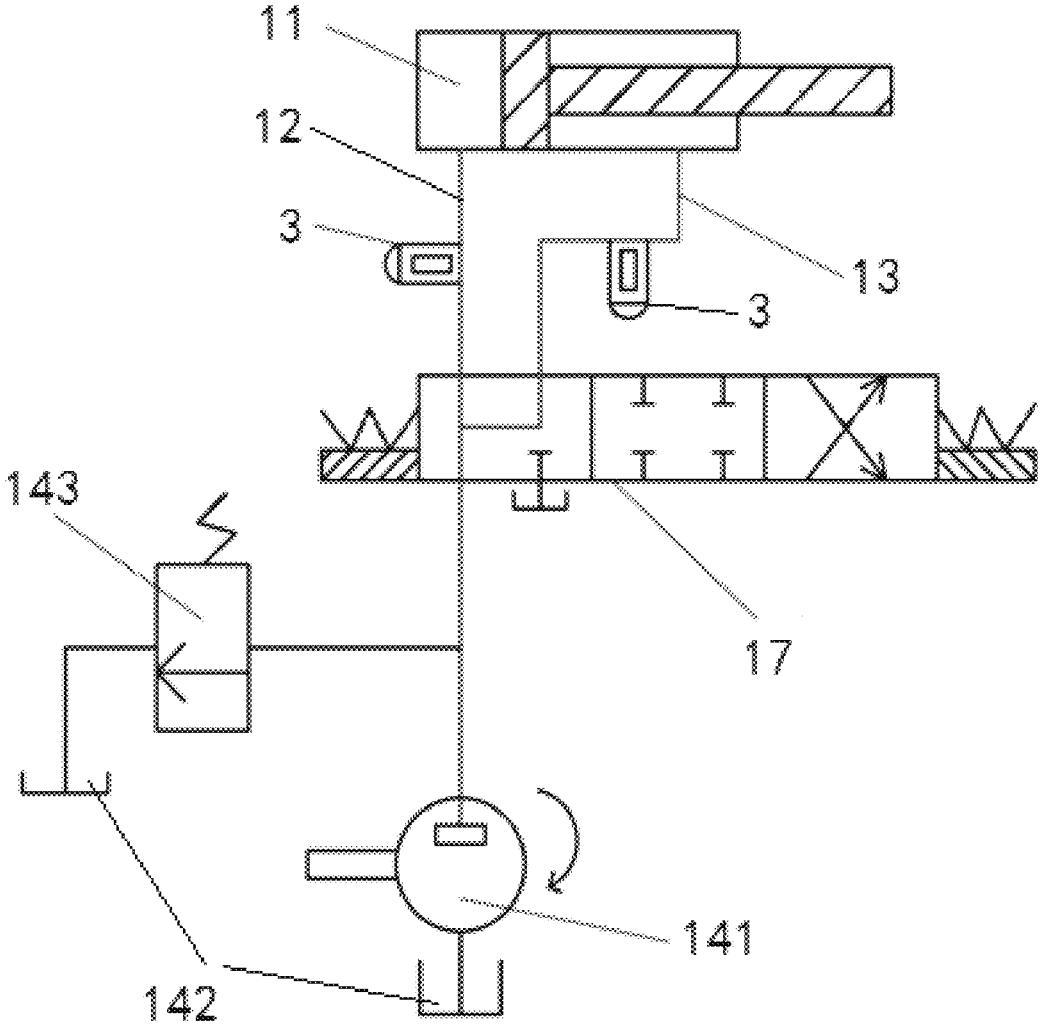
FIG. 7 is a hydraulic circuit diagram 1 of a single track lining hydro-cylinder in a tamping car-based system for detecting a mechanical quality state of a ballast bed in real time according to an embodiment of the present application.
Figure 8:
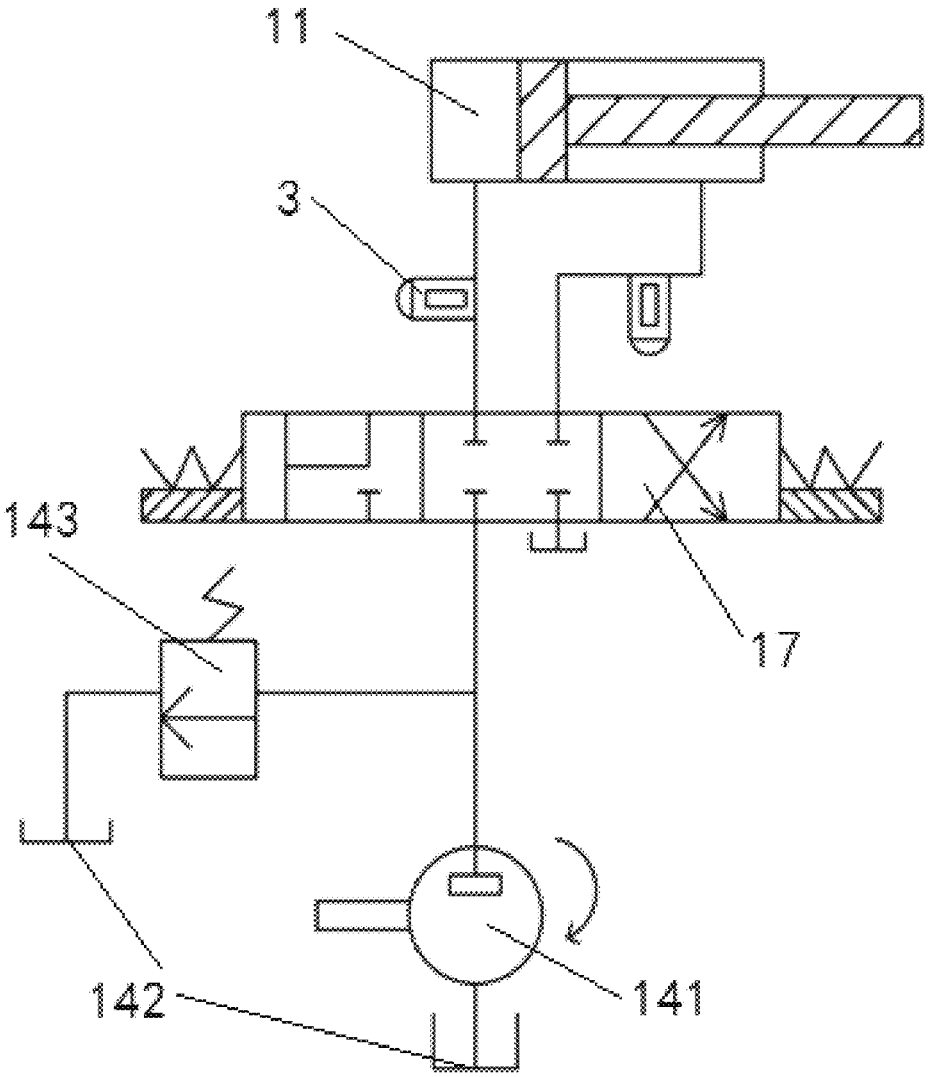
FIG. 8 is a hydraulic circuit diagram 2 of a single track lining hydro-cylinder in a tamping car-based system for detecting a mechanical quality state of a ballast bed in real time according to an embodiment of the present application.
Figure 9:
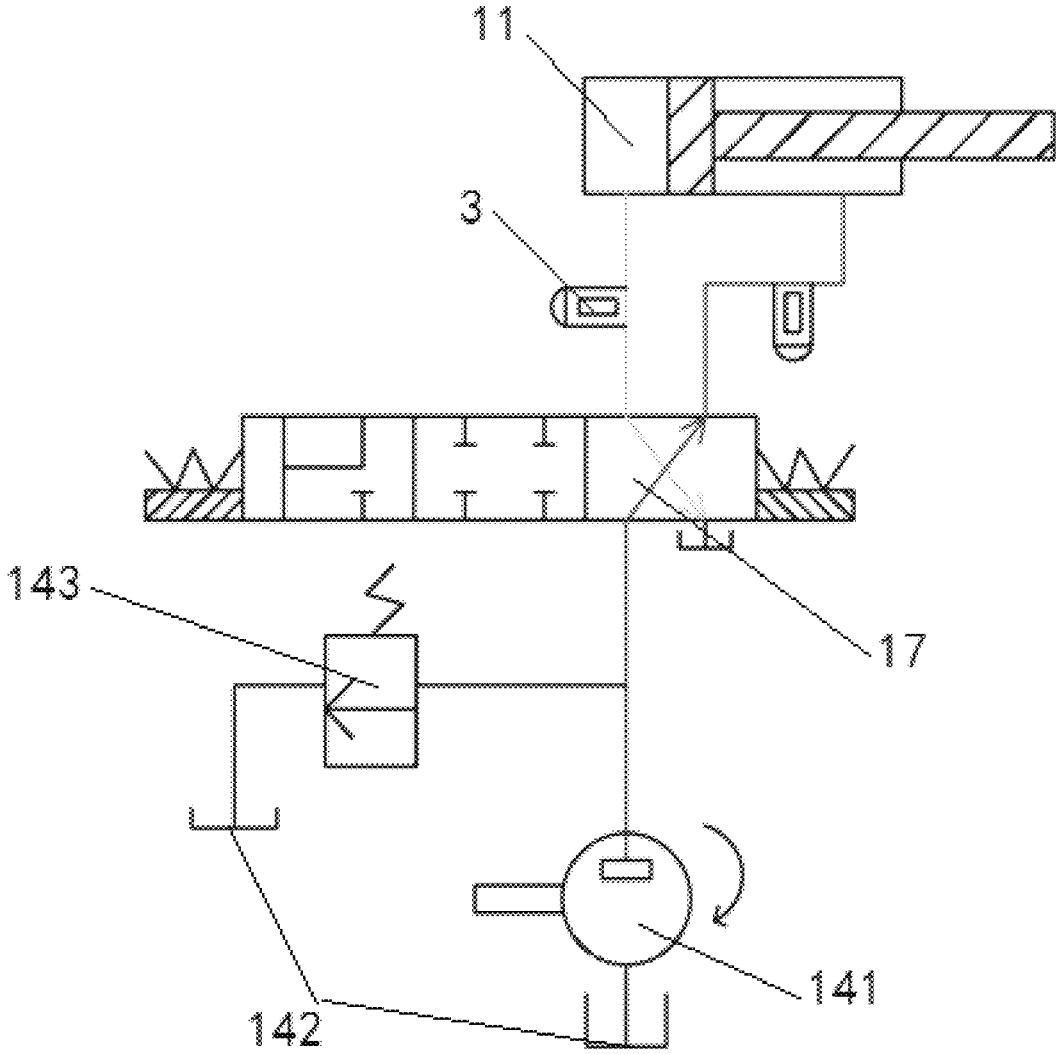
FIG. 9 is a hydraulic circuit diagram 3 of a single track lining hydro-cylinder in a tamping car-based system for detecting a mechanical quality state of a ballast bed in real time according to an embodiment of the present application.

Referring to FIGS. 7 to 9, the hydraulic control system 14 further includes a one-way hydraulic pump 141 and an oil tank 142, a P-type three-position four-way servo solenoid directional control valve 17 is arranged between the track lining hydro-cylinders 11 and the one-way hydraulic pump 141, and the diffused silicon pressure transmitters 3 are positioned on pipelines between the track lining hydro-cylinders 11 and the P-type three-position four-way servo solenoid directional control valve 17. A high-pressure relief valve 143 is further arranged on a pipeline between the one-way hydraulic pump 141 and the P-type three-position four-way servo solenoid directional control valve 17, and an outlet of the high-pressure relief valve 143 communicates with the oil tank 142.

The tamping apparatus 2 includes two pairs of tamping components 21 arranged on both sides, each tamping component 21 includes a pair of packer arms 211 and two pairs of packers 212, and the packer arms 211 are connected to a machine frame 6. A joint between the packer arm 211 and the packer 212 is provided with a dynamic force sensor, and the dynamic three sensor is capable of detecting a transient dynamic downward insertion force generated when the packer 212 is inserted into the ballast bed, so that the vertical mechanical property of the ballast bed is reflected. The dynamic force sensors are quartz dynamic impact force sensors 4, the packer arms 211 and the packers 212 are connected through bolts 213, and the quartz dynamic impact force sensors 4 are arranged outside the bolts 213 in a sleeving manner. Reinforced grommets 5 are arranged between the quartz dynamic impact force sensors 4 and the packer arms 211 and between the quartz dynamic impact force sensors 4 and the packers 212, which makes the measurement smoother and has higher measurement accuracy.

Figure 11:
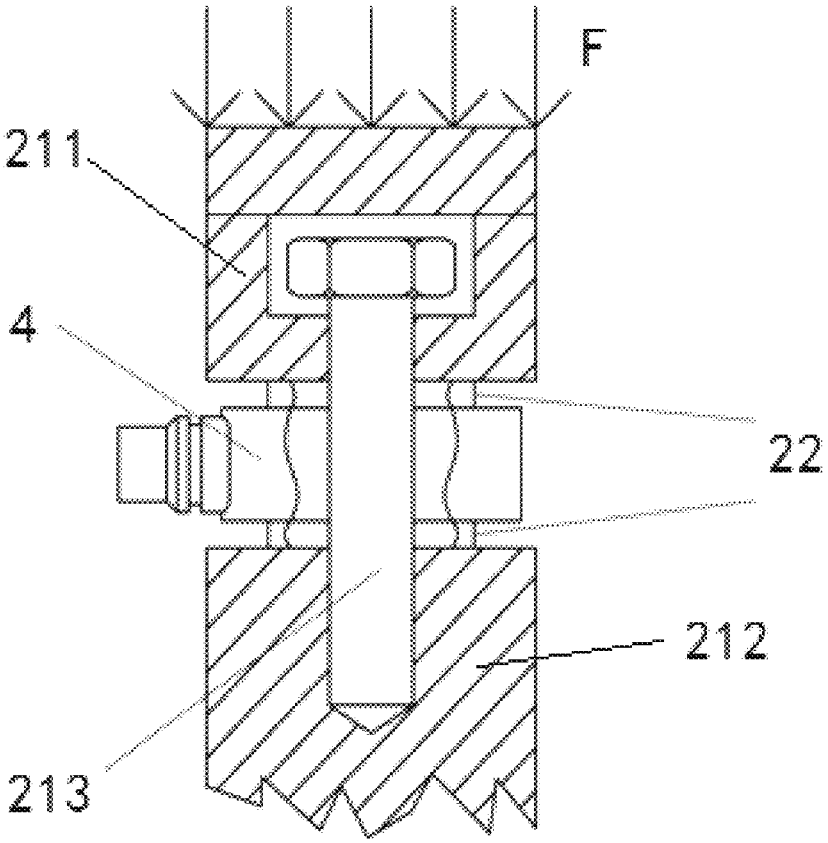
FIG. 11 is a schematic diagram of an operating principle of a quartz dynamic impact force sensor in a tamping car-based system for detecting a mechanical quality state of a ballast bed in real time according to an embodiment of the present application.
Figure 12:
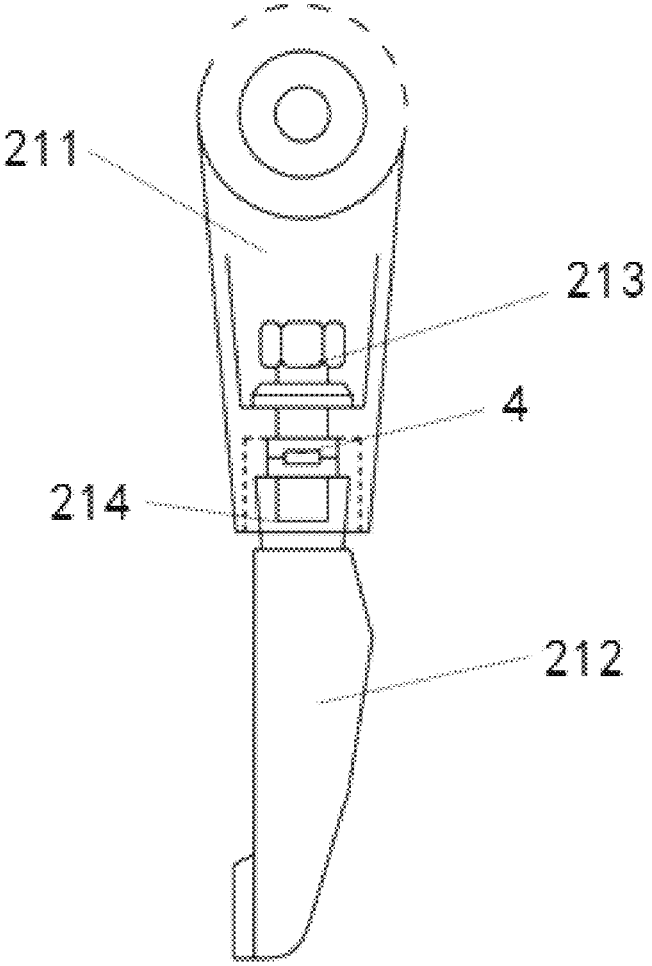
FIG. 12 is a schematic diagram of installation of a quartz dynamic impact force sensor in a tamping car-based system for detecting a mechanical quality state of a ballast bed in real time according to an embodiment of the present application.

Referring to FIGS. 11 and 12, an operating principle of the quartz dynamic impact force sensor 4 is as follows:

The packer 212 is inserted into the ballast bed and is subjected to an upward reaction force of a ballast, and the reaction force is closely related to the compactness and the anti-vertical deformation capability of the ballast bed. Therefore, a ballast impact force borne by the packer 212 can effectively reflect the vertical mechanical property of the ballast bed. The action force of the ballast on the packer 212 is transmitted to the quartz dynamic impact force sensor 4, a quartz crystal serves as a sensitive element and operates in a compression mode under the action of an external force F, that is, strain occurs. Meanwhile, the surface generates charge and the amount of charge generated becomes an accurate proportional relationship with its own strain, and the measured amount of charge can reflect a size of the external action force. The quartz dynamic impact force sensor 4 is mounted outside the bolt 213 connecting the packer arm 211 and a handle 214 of the packer 212 in a sleeving manner, and the reinforced grommets 22 are mounted on stressed contact surfaces, which is conducive to flatness of the measurement. When the bolts 213 are tightened, the quartz dynamic impact force sensors 4 are pressed by the bolts 213 and output a signal, Through a pre-tightening force of the bolts 213, the quartz dynamic impact force sensors 4 can be in close contact with a measured object, and the measurement precision is improved.

The working mechanism of the tamping car-based system for detecting a mechanical quality state of a ballast bed in real time according to the embodiments of the present application is as follows.

In the track lining process, the track lining wheel 15 is driven by the track lining hydro-cylinder 11 to apply a transverse force to a track panel to complete a track lining operation, an oil pressure of an oil pipeline connected with the track lining hydro-cylinder 11 is measured through the pressure sensor, and the thrust of the piston rod, that is, the action force applied to the ballast bed by the track lining wheel 15, is obtained through calculation of the data processing unit, and further the transverse mechanical property of the ballast bed is reflected.

In the tamping process, the packer 212 is tamped into the ballast bed under the action of a lifting hydro-cylinder 22, the dynamic force sensor measures the transient dynamic downward insertion three generated when the packer 21 is inserted downward into the ballast bed, and the vertical mechanical property of the ballast bed is reflected. A basic principle used in the present patent mainly includes operating principles of the diffused silicon pressure transmitter 3, the quartz dynamic impact force sensor 4, and detection principles of the transverse and vertical mechanical properties of the ballast bed.

Specifically, the detection of the ballast bed transverse mechanical property includes measurement of a hydraulic loop of a single hydro-cylinder and measurement of a combined hydraulic loop of multiple hydro-cylinders. Referring to FIGS. 7 to 9, a track lining wheel rim applies a horizontal right or left three to a rail head of the steel rail, so that the whole section of track panel moves transversely, and adjustment in a rail direction is completed. In the track lining system hydraulic system, a track lining control system circuit operation is converted into a track lining servo current, and an opening degree and opening direction of the P-type three-position four-way servo solenoid directional control valve 17 are controlled, so that a linear reciprocating motion of a track lining hydro-cylinder piston is controlled. Meanwhile, a track lining bypass valve 18 is further arranged on a hydraulic control loop to realize functions of pressure building and pressure relief of the track lining system.

Referring to FIG. 7, when the P-type three-position four-way servo solenoid directional control valve 17 is in a left position, it is differentially connected. At the moment, a rod cavity and a rodless cavity of the track lining hydro-cylinder 11 are interconnected, when a pressure oil is introduced, an area of the rodless cavity is larger than an area of the rod cavity, a rightward thrust of the piston is larger than a leftward thrust thereof, so that the piston moves rightward, and meanwhile oil discharged from the rod cavity enters the rodless cavity, a flow rate flowing into the rodless cavity is increased, thereby accelerating a moving speed of the piston. A piston thrust can be calculated from the measured pressure and piston rod diameter according to a pressure formula. It should be noted that the piston thrust can be calculated manually or by the data processing unit.

Referring to FIG. 8, when the P-type three-position four-way servo solenoid directional control valve 17 is positioned at a middle position, a valve port is not communicated at the moment, no track lining signal is generated, a bypass valve is in a power-off state, a pressure of the track lining hydraulic loop is relieved, the track lining hydro-cylinder is in a free floating state, and the track lining wheel has no pressure on the steel rail.

Referring to FIG. 9, when the P-type three-position four-way servo solenoid directional control valve 17 is positioned at a right position, the oil inlet pipe is connected with the rod cavity, the oil outlet pipe is connected with the rodless cavity, and a pressure in the rod cavity is strong, thereby driving the piston rod to move leftward, Because the two cavities are not interconnected with each other, a pressure difference is formed at the oil inlet pipe and oil outlet pipe, and the piston thrust at the moment can be calculated according to the pressure formula.

Figure 10:
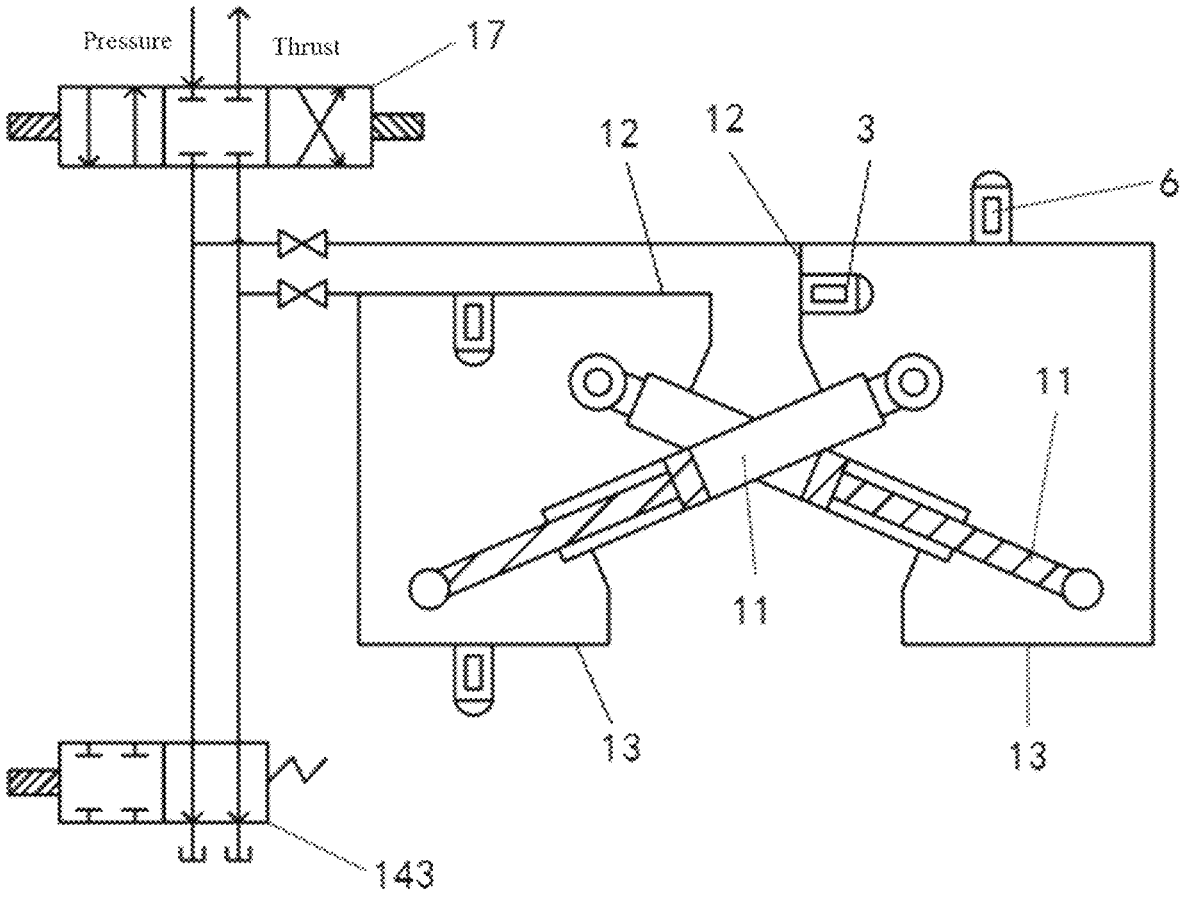
FIG. 10 is a hydraulic circuit diagram of a pair of track lining hydro-cylinders in a tamping car-based system for detecting a mechanical quality state of a ballast bed in real time according to an embodiment of the present application.

Referring to FIG. 10, in general, one track lining hydro-cylinder 11 controls one track lining wheel 15, and a pair of track lining wheels 15 respectively acts on the left, and right two steel rails during the track lining, so as to realize a synchronous movement of the two steel rails. Two pairs of track lining wheels 15 are arranged in the track lining apparatus and are respectively controlled by the two pairs of track lining wheels 15. The two track lining hydro-cylinders 11 are connected in a cross-parallel manner. When the oil inlet pipeline 12 is connected with the rod cavity of one track lining hydro-cylinder 11, the oil inlet pipeline 12 is connected with the rodless cavity of the other track lining hydro-cylinder 11 in a cross-parallel manner, that is, the transverse force applied to the steel rail by the pistons of the two track lining hydro-cylinders is in the same direction, and a synchronous track lining can be realized.

The above are merely the specific embodiments of the present application, but the protection scope of the present application is not limited thereto, and any changes or substitutions within the technical scope disclosed in the present application should fall within the protection scope of the present application. Therefore, the protection scope of the present application should be subject to the protection scope of the claims.

What is claimed is:

1. A tamping car-based system for detecting a mechanical quality state of a ballast bed in real time, comprising a track lining apparatus and two tamping apparatuses arranged in parallel;

wherein the track lining apparatus comprises two track lining hydro-cylinders, the track lining hydro-cylinders communicate with a hydraulic control system through an oil inlet pipeline and an oil return pipeline; pressure sensors configured to detect pressures of the pipelines are arranged on both the oil inlet pipeline and the oil return pipeline;

the tamping apparatus comprises two pairs of tamping components arranged on both sides, the tamping component comprises a pair of packer arms and two pairs of packers; a dynamic force sensor is provided at a joint between the packer arm and the packer, and the dynamic force sensor can detect a transient dynamic downward insertion force generated when the packer is inserted into the ballast bed;

further comprising a data processing unit, wherein the data processing unit is electrically connected with the pressure sensors and can receive pipeline pressures detected by the pressure sensors and output a thrust of a piston rod;

wherein the pressure sensor is a diffused silicon pressure transmitter, and the diffused silicon pressure transmitter is connected to the oil inlet pipeline or the oil return pipeline through an impulse pipe;

wherein the two track lining hydro-cylinders are arranged in a cross-parallel manner.

2. The tamping car-based system for detecting a mechanical quality state of a ballast bed in real time according to claim 1, wherein the packer arms and the packers are connected through bolts, the dynamic force sensors are quartz dynamic impact force sensors, and the quartz dynamic impact force sensors are sleeved on an outside of the bolts.

3. The tamping car-based system for detecting a mechanical quality state of a ballast bed in real time according to claim 2, wherein reinforced grommets are arranged between the quartz dynamic impact force sensors and the packer arms and between the quartz dynamic impact force sensors and the packers.

4. The tamping car-based system for detecting a mechanical quality state of a ballast bed in real time according to claim 1, wherein the hydraulic control system further comprises a one-way hydraulic pump, a three-position four-way directional control valve is arranged between the track lining hydro-cylinders and the one-way hydraulic pump, and the pressure sensors are positioned on pipelines between the track lining hydro-cylinders and the three-position four-way directional control valve.

5. The tamping car-based system for detecting a mechanical quality state of a ballast bed in real time according to claim 4, wherein the three-position four-way directional control valve is a P-type three-position four-way servo solenoid directional control valve.

6. The tamping car-based system for detecting a mechanical quality state of a ballast bed in real time according to claim 5, wherein the hydraulic control system further comprises an oil tank, a relief valve is further arranged on a pipeline between the one-way hydraulic pump and the three-position four-way directional control valve, and an outlet of the relief valve communicates with the oil tank.

* * * * *